US007272903B2

(12) United States Patent
Roy

(10) Patent No.: US 7,272,903 B2
(45) Date of Patent: Sep. 25, 2007

(54) PICTURE FRAME TURN BUTTON

(76) Inventor: Armand E. Roy, 95 Payson St., Attleboro, MA (US) 02703

( * ) Notice: Subject to any disclaimer, the term of this patent is extended or adjusted under 35 U.S.C. 154(b) by 260 days.

(21) Appl. No.: 11/061,683

(22) Filed: Feb. 18, 2005

(65) Prior Publication Data

US 2006/0059759 A1 Mar. 23, 2006

Related U.S. Application Data

(60) Provisional application No. 60/571,115, filed on May 14, 2004.

(51) Int. Cl.
*A47G 1/06* (2006.01)

(52) U.S. Cl. ..... 40/790; 40/796; 292/241; 292/281

(58) Field of Classification Search ..... 40/790, 40/796, 780; 411/501; 248/497; 292/DIG. 35, 292/241, 281
See application file for complete search history.

(56) References Cited

U.S. PATENT DOCUMENTS

| | | | | | |
|---|---|---|---|---|---|
| 0,157,116 | A | | 11/1874 | Bray | |
| 0,216,719 | A | | 6/1879 | Bray | |
| 418,261 | A | * | 12/1889 | Wright | 40/739 |
| 0,908,608 | A | | 1/1909 | Pullen | |
| 1,168,832 | A | * | 1/1916 | Smernoff | 40/790 |
| 1,356,575 | A | * | 10/1920 | Weiss | 40/746 |
| 1,389,587 | A | * | 9/1921 | Hilborn | 40/611.12 |
| 1,544,464 | A | * | 6/1925 | Long | 292/218 |
| 2,650,124 | A | * | 8/1953 | Olson | 292/194 |
| 2,798,327 | A | * | 7/1957 | Dibb | 40/790 |
| 2,820,311 | A | * | 1/1958 | Hamlin | 40/790 |
| 3,312,494 | A | * | 4/1967 | Antonioli | 292/281 |
| 3,665,629 | A | | 5/1972 | Shore | 40/156 |
| 4,689,906 | A | | 9/1987 | Sherman | 40/152.1 |
| 4,790,089 | A | | 12/1988 | Astolfi | 40/156 |
| 4,805,325 | A | | 2/1989 | Cassard | 40/152 |
| 4,996,784 | A | | 3/1991 | Hsu | 40/152 |
| 5,379,537 | A | | 1/1995 | Roy | 40/156 |
| 6,125,567 | A | | 10/2000 | Roy | 40/790 |

FOREIGN PATENT DOCUMENTS

| | | |
|---|---|---|
| DE | 147941 | 11/1902 |
| DE | 3635-915 | 10/1986 |

* cited by examiner

*Primary Examiner*—Gary C. Hoge
(74) *Attorney, Agent, or Firm*—Barlow, Josephs & Holmes, Ltd.

(57) ABSTRACT

A picture frame turn button has a base plate with at least one fastener for attaching the base plate securely to a picture frame back. Pivotably mounted to the base plate is a latch plate with an arm and a tongue portion opposite of each other. The latch plate may be pivoted about base plate between an engaged state, where the picture frame back is locked closed, and a disengaged state, where the picture frame back may be removed to replace a picture sandwiched between the picture frame and picture frame back.

3 Claims, 11 Drawing Sheets

PICTURE FRAME TURN BUTTON

CROSS-REFERENCE TO RELATED APPLICATION

This application claims priority to earlier filed U.S. Provisional Application Ser. No. 60/571,115, filed on May 14, 2004, the contents of which are incorporated herein by reference.

BACKGROUND OF THE INVENTION

The present invention relates to picture frame hardware and methods of manufacturing the same and more particularly to the present invention relates to turn button hardware. In the picture frame industry, there are various types of picture frame hardware, which includes easel hinges for hingedly attaching a strut to a picture frame back, and a turn buttons for maintaining a picture frame back inside a frame with a photo or artwork sandwiched therebetween. There is a need for a structure to maintain this construction together.

Referring now to FIGS. 1 through 5, prior art turn buttons, shown generally at 10, 20, and 30, are typically tab-like structures that are attached to a picture frame back 12, 22, 32. The tabs 14, 24, 34, are pivotally attached to the back 12, 22, 32 so that they may pivot in place. The free ends 16, 26, 36 of the turn button tabs 14, 24, 34, when in a locked position, reside within a groove in the picture frame (not shown) to secure it in place. When pivoted to an open position, the tabs 14, 24, 34 are no longer engaged with the frame so the picture frame back 12, 22, 32 can be freely removed to gain access to the back of the picture frame itself to insert or remove a picture therefrom. Also, a turn button 10, 20, 30 can be attached to the picture frame itself and pivoted or bent to communicate with the picture frame back 12, 22, 32.

In general, prior art turn buttons are typically attached to the picture frame back by a rivet 18 (see FIG. 1) or simply punched therethrough (see FIGS. 2 through 5). This attachment dictates the pivoting tension of the turn button itself. For example, a very secure rivet connection will result in a very tight turn button making it very difficult to turn for the user of the frame. In this prior art turn button, it is pivotally connected directly to the cardboard itself of the picture frame back. Over time, this tight connection will eventually degrade rendering the turn button unusable.

Also, a loose attachment makes it easier to manipulate the turn button but the connection will also be loose making a poor locking connection and/or making it possible for the turn button to fall off of the picture frame back completely. Moreover, over time the turn button will tend to loosen as it is used, thus increase the chances that the turn button may malfunction as described previously.

SUMMARY OF THE INVENTION

The present invention preserves the advantages of prior art turn buttons for picture frames and methods of manufacturing and installing the same. In addition, the improved turn button of the present invention provides new advantages not found in currently known devices and overcomes many disadvantages of such currently available devices.

Accordingly, the present invention is directed to a picture frame turn button having a base plate with fasteners for attaching the base plate securely to a picture frame back. Pivotably mounted to the base plate is a latch plate with an arm and a tongue portion opposite of each other. The latch plate may be pivoted about base plate between an engaged state, where the picture frame back is locked closed, and a disengaged state, where the picture frame back may be removed to replace a picture sandwiched between the picture frame and the picture frame back.

Additionally, the base plate may include a convex detent stop and the latch plate a complimentary concave detent seat, which when pivoted to the engaged state, locks the latch plate into the base plate.

The picture frame turn button of the present invention is unique because the latch plate can easily pivot on the base plate due to the quality smooth rotation at the pivot. Thus, the user can easily pivot the latch plate thereabout because a metal to metal pivot is maintained. A freely turning turn button, as in the prior art, is not desired because the device can easily open when not intended to do so and vice versa. However, the present invention uniquely includes the aforesaid detent stop engagement the concave detent seat of the latch plate to snap the latch plate into a locking engagement. Therefore, the present invention enables a turn button to be both easy to turn and to securely lock into place.

Further, the present invention is directed to a picture frame turn button in coil-fed form so that it may be automatically mounted to a picture frame back via an automatic mounting machine. The coil-fed turn button has a plurality of base plates connected together by a cutaway tab. Pivotably mounted on the plurality of base plates are a complimentary plurality of latch plates. Similar to the turn button described above, the latch plate may be operated between an engaged state and a disengaged state.

The present invention solves the problems of the prior art by providing a base plate that may be securely mounted to the picture frame back so that it will not loosen over time as the latch plate is operated.

Additionally, the force that is required to manipulate the latch plate between the engaged and disengaged states may be selected, through machine tooling, at a level that is comfortable for most consumers but avoids an overly loose turn button, which is viewed as undesirable.

DESCRIPTION OF THE DRAWINGS

These and other features, aspects, and advantages of the present invention will become better understood with reference to the following description, appended claims, and accompanying drawings where:

DETAILED DESCRIPTION OF THE PREFERRED EMBODIMENT

Figure 1:
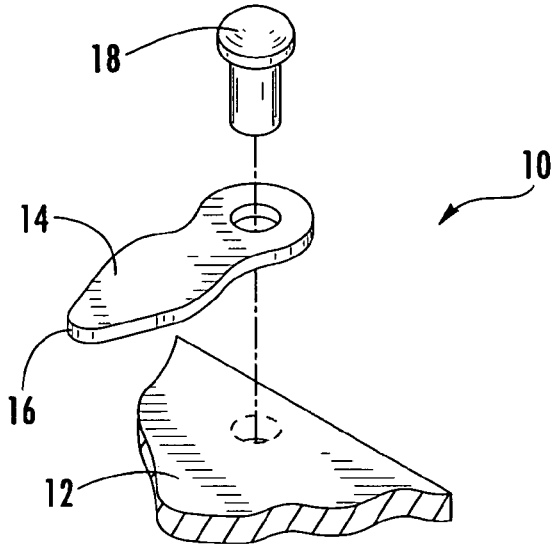
FIG. 1 (PRIOR ART)
FIG. 1 is an exploded view of a prior art turn button.
Figure 2:
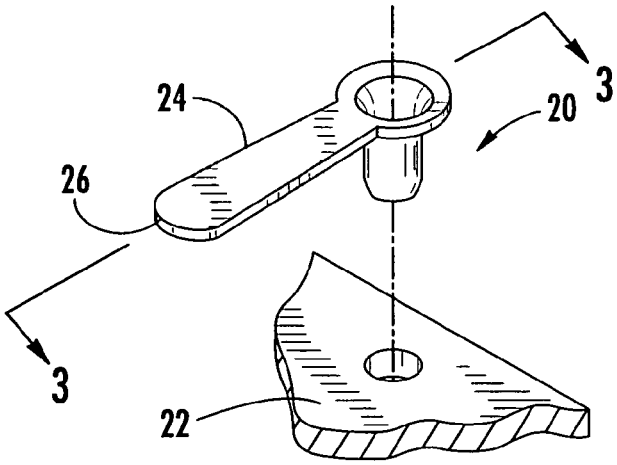
FIG. 2 (PRIOR ART)
FIG. 2 is exploded view of another prior art turn button.
Figure 3:
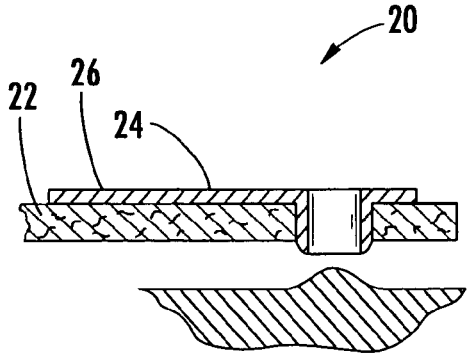
FIG. 3 (PRIOR ART)
FIG. 3 is a cross-sectional view of a prior art turn button through line.
Figure 4:
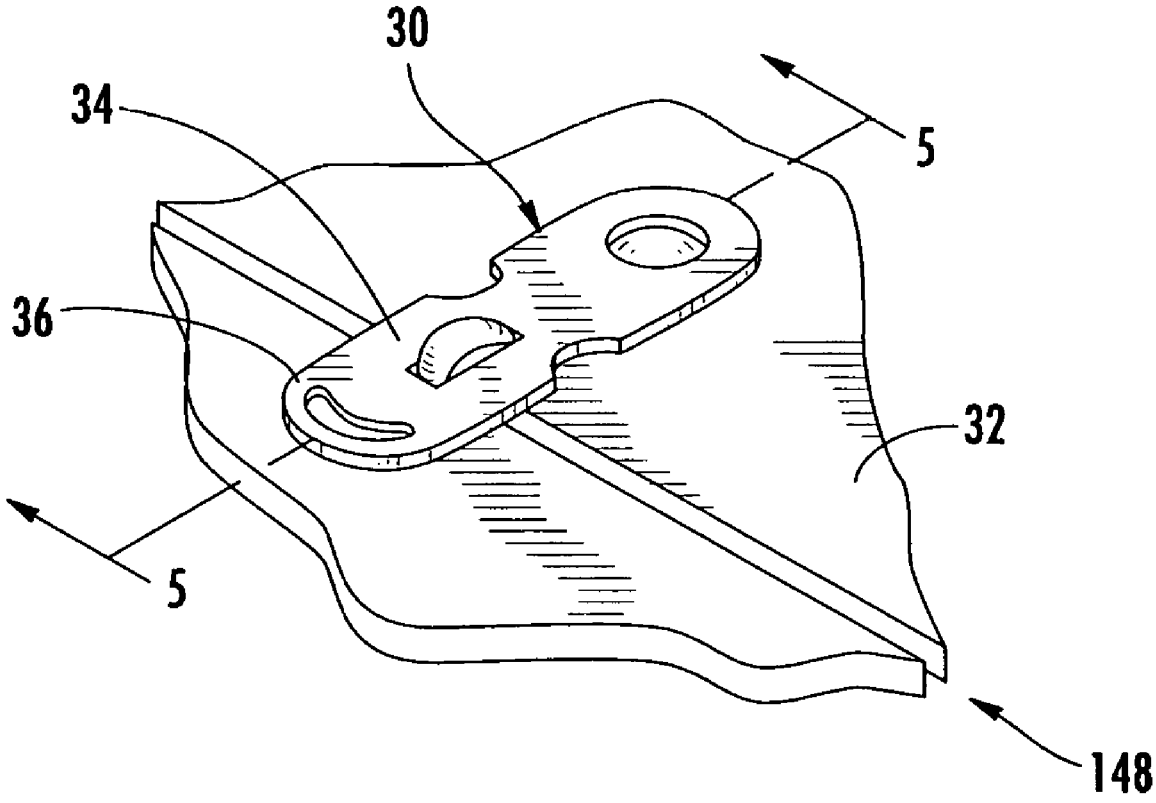
FIG. 4 (PRIOR ART)
FIG. 4 is a perspective view of the prior art turn button of FIGS. 2-3 through the line 3-3 of FIG. 2.
Figure 5:
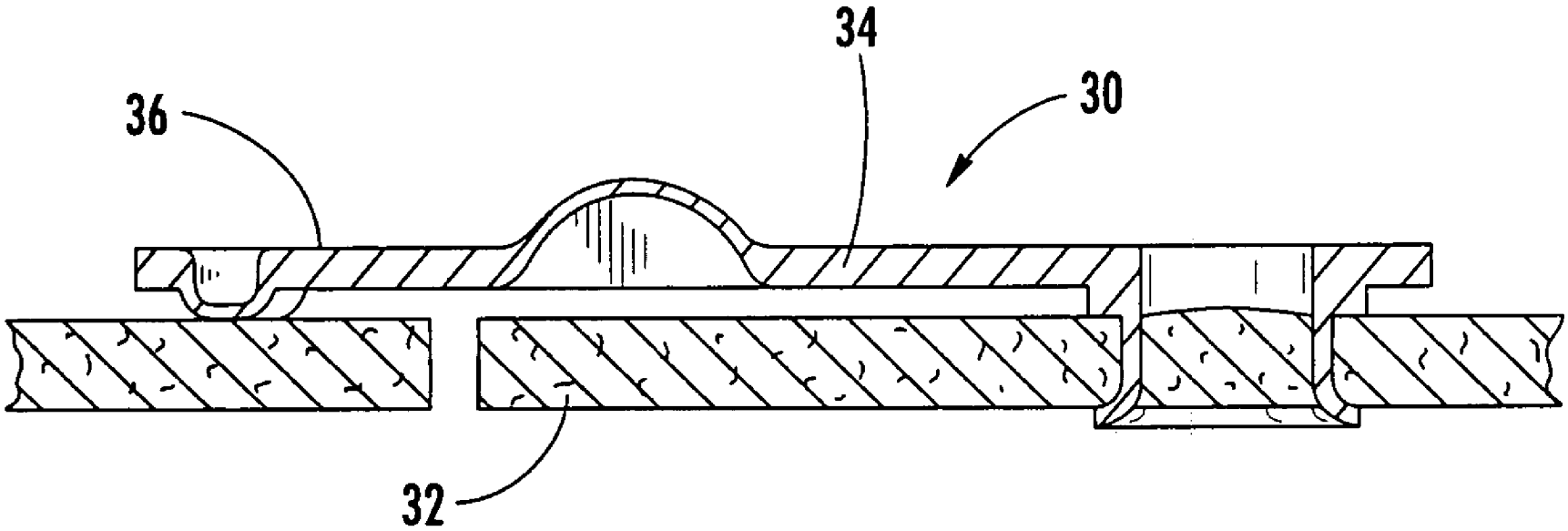
FIG. 5 (PRIOR ART)
FIG. 5 is a cross-sectional view through the line 5-5 of FIG. 4 of a prior art turn button in the engaged state.

Referring now to FIGS. 6A through 8B, an embodiment of the turn button of the present invention is shown generally at 100 mounted on a picture frame 102 with a picture frame back 104 installed therein. The turn button 100 comprises a base plate 106 and a latch plate 108 pivotably mounted thereon 106 so it 108 may be operated between an engaged state (see FIGS. 6B, 7B, 8B) and a disengaged state (see FIGS. 6A, 7A, 8A).

Figure 6A:
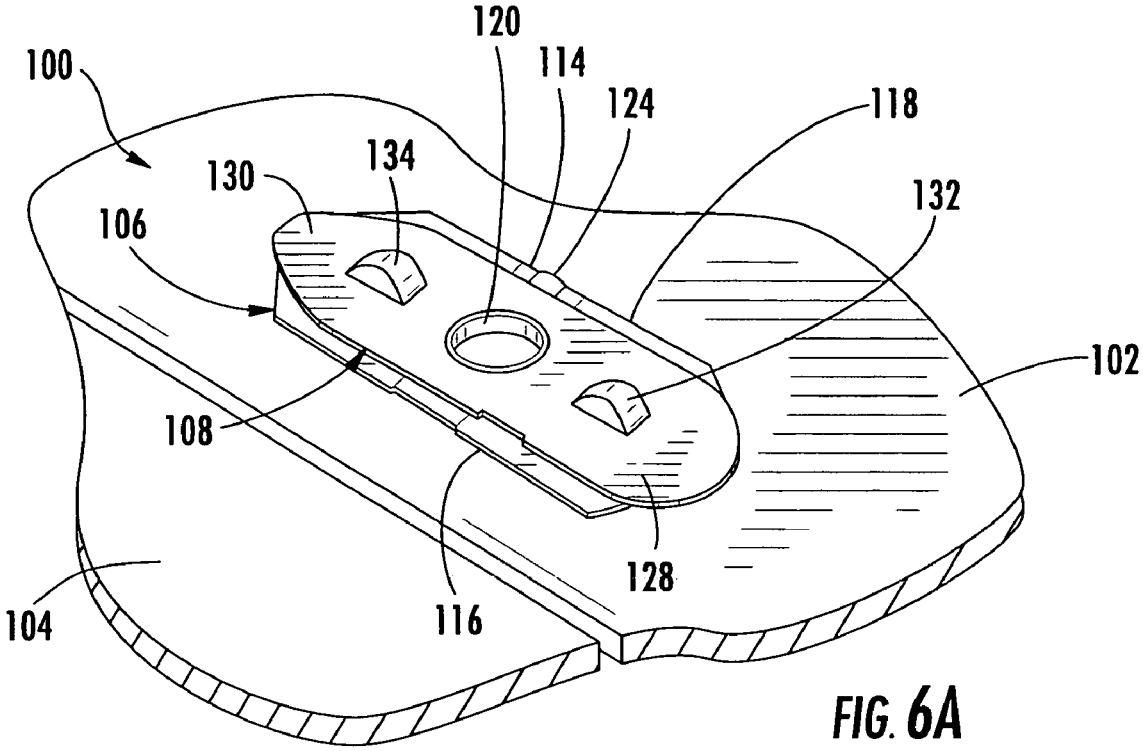
FIG. 6A is a top perspective view of the preferred embodiment of the present invention mounted and in the disengaged state.
Figure 6B:
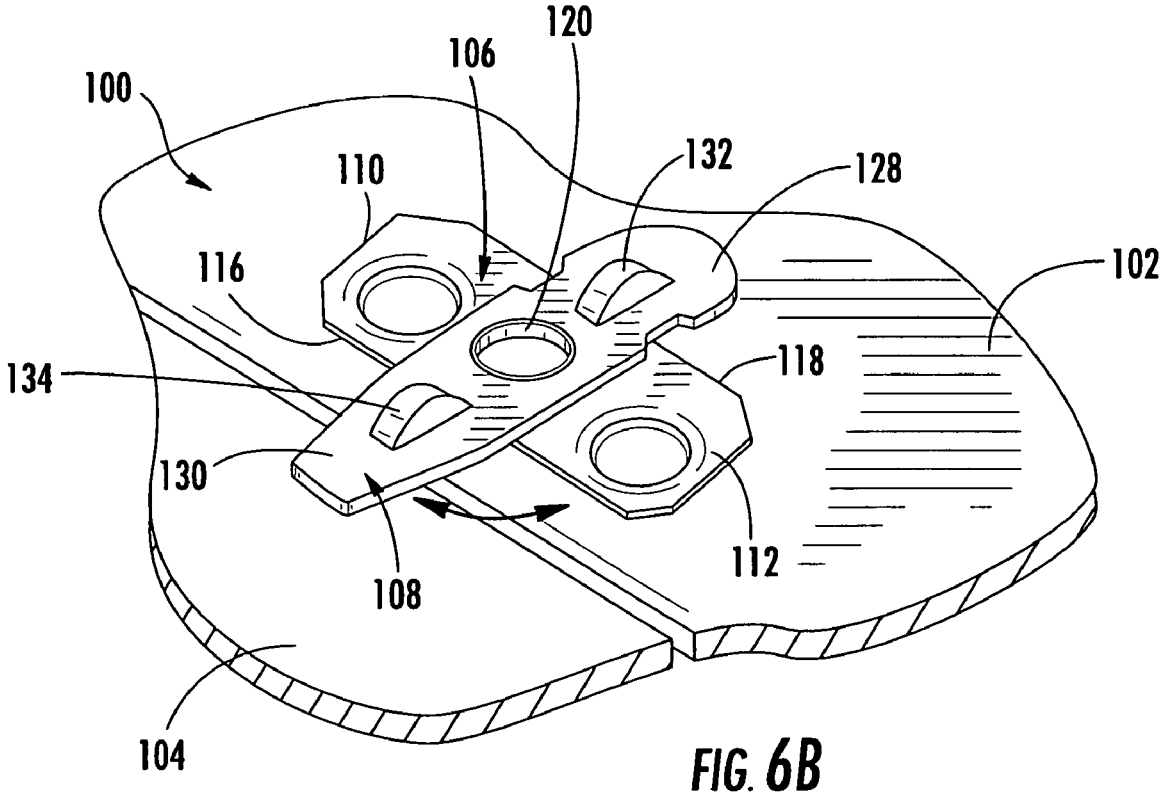
FIG. 6B is a top perspective view of the turn button of FIG. 6A of the present invention mounted and in the engaged state.
Figure 7A:
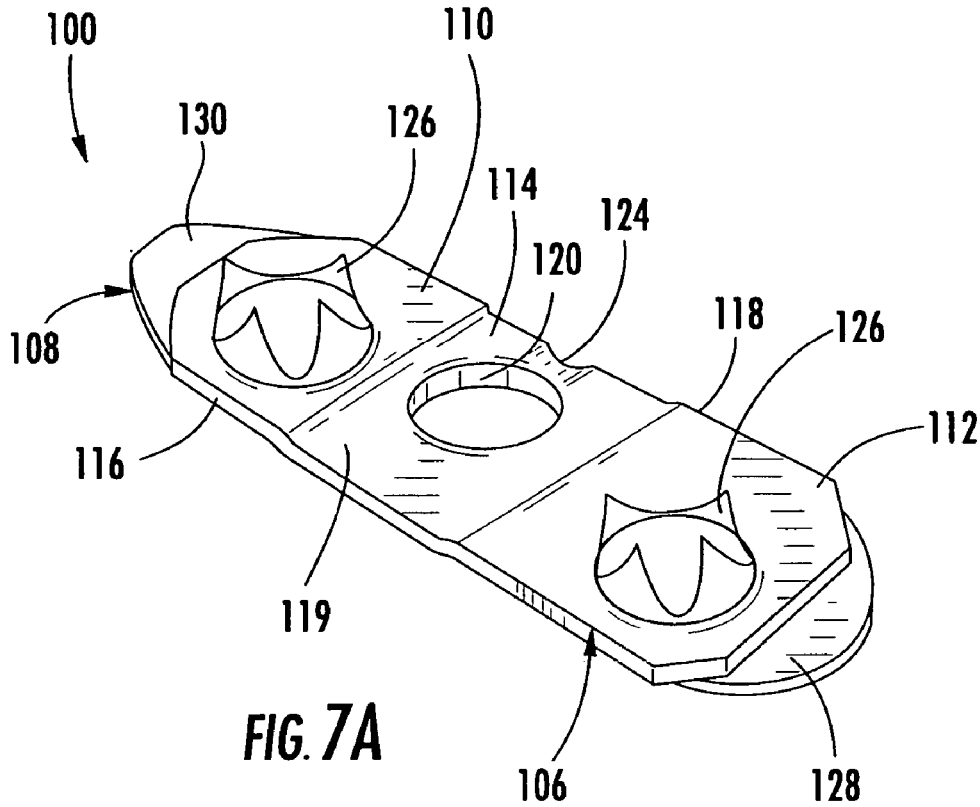
FIG. 7A is a bottom perspective view of the turn button of the present invention in the disengaged state.
Figure 7B:
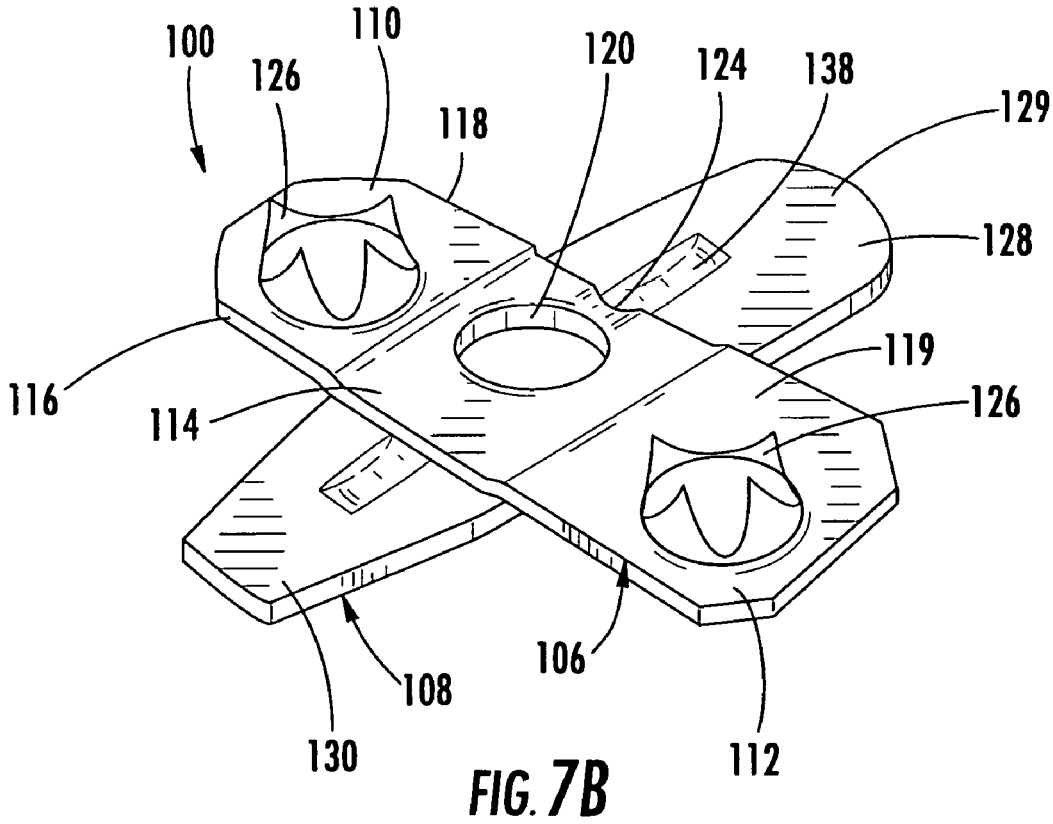
FIG. 7B is a bottom perspective view of the turn button of the present invention in the engaged state.
Figure 8A:
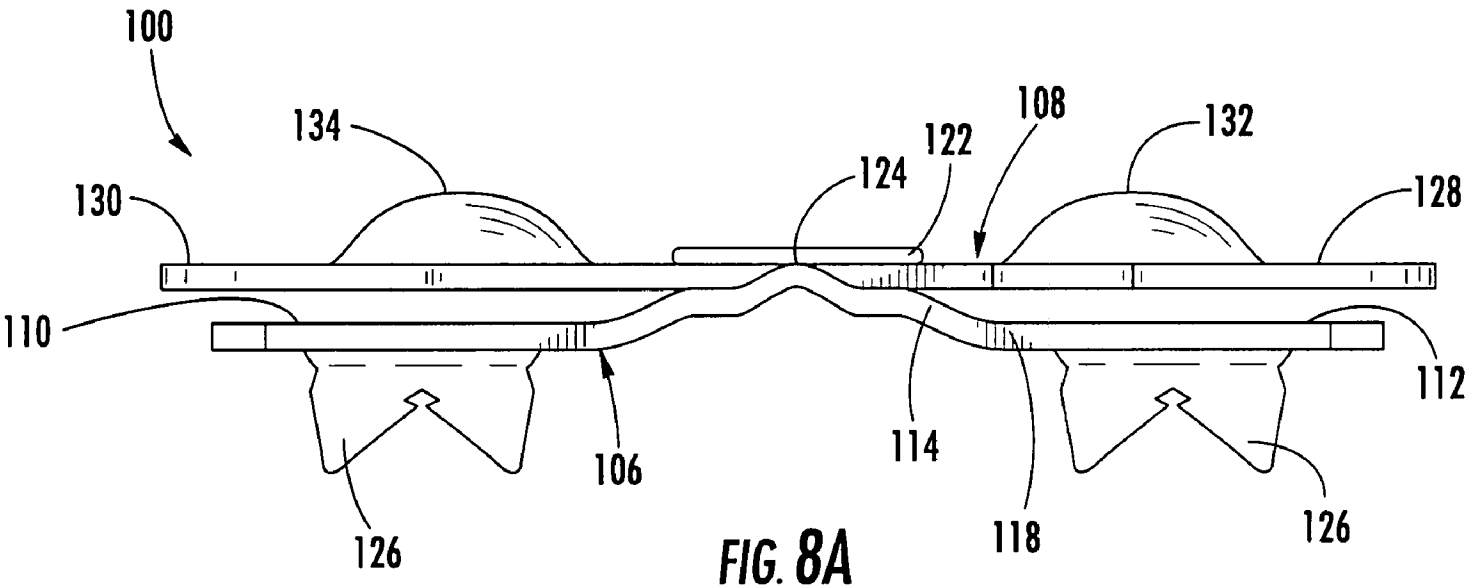
FIG. 8A is a rear elevational view of the turn button of the present invention in the engaged state.
Figure 8B:
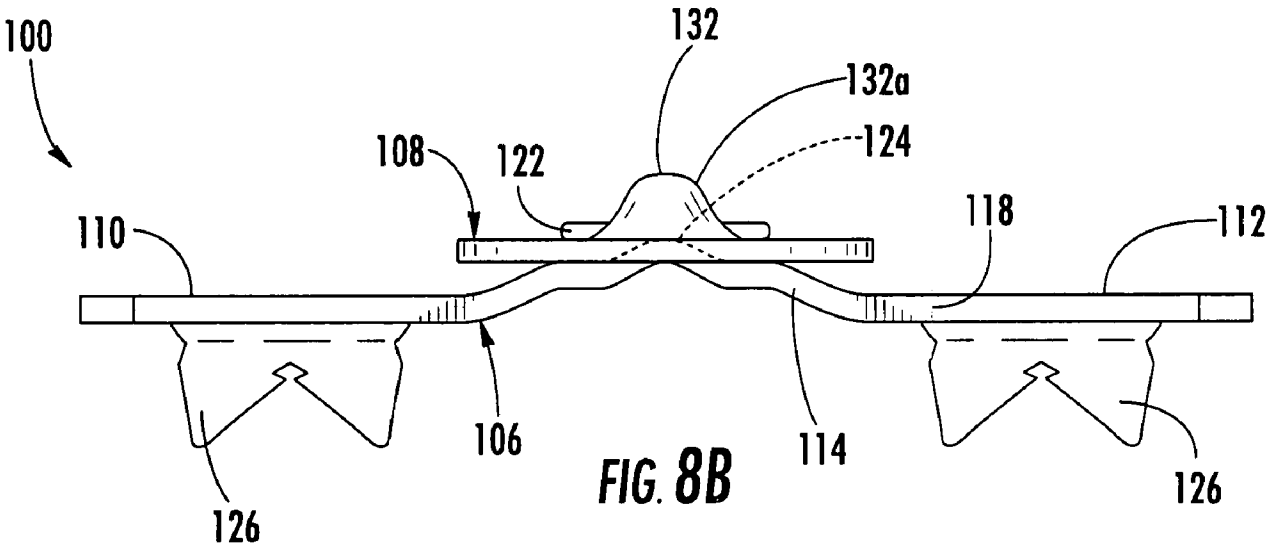
FIG. 8B is a rear elevational view the turn button of the present invention in the disengaged state.

In FIGS. 6A and 6B, the turn button 100, is shown installed on the frame 102 to prevent the picture frame back 104 from hingedly opening and exposing the picture therein. In particular, FIGS. 6A through 8B show how the detent stop 124 of the base plate 106 fits into the detent seat 138 on the latch plate 108 when the latch plate 108 is rotated about the pivot wall 120. A consumer pivots the latch plate 108 by using the thumb and forefinger to push in a twisting motion the two raised shoulders 132, 134. As the latch plate 108 pivots, the detent stop 124 meets resistance to the rotation because as the latch plate 108 rides up and over the detent stop 124 a perpendicular twisting force is applied to the pivot wall 120, upper lip 122, and the base plate 106. This resistive force also keeps the latch plate 108 from moving off of the detent stop 124 of the base plate 106 once engaged. This same resistive force must be overcome by the consumer when they attempt to pivot the latch plate 108 to the disengaged state.

Some picture frame backs 104 have an outer peripheral area (not shown) that is secured to the frame with a central hingedly connected portion of the picture frame back 104. In this case the turn button 100 may be installed onto the outer peripheral area to prevent the inner central portion from hingedly opening. Such turn button environments are well known in the art and can all be accommodated by the turn button of the present invention.

Figure 9:
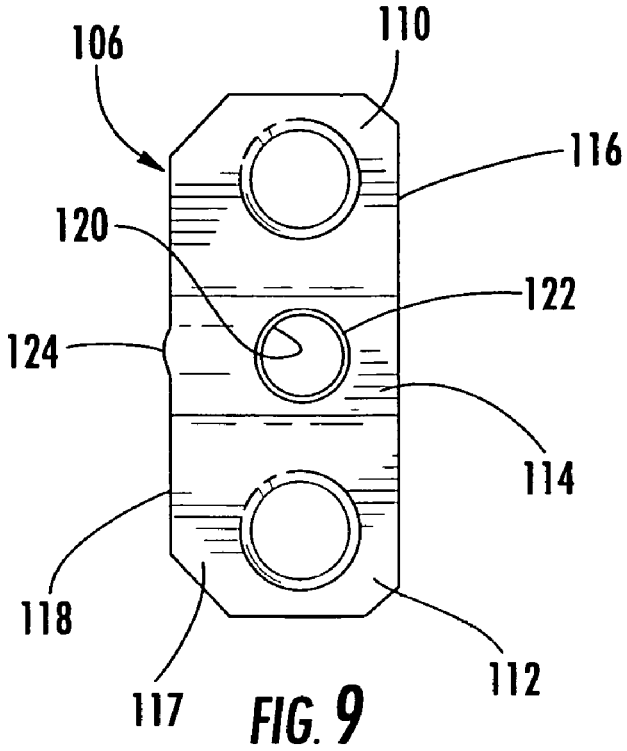
FIG. 9 is a top plan view an embodiment of the base plate of the present invention.
Figure 10:
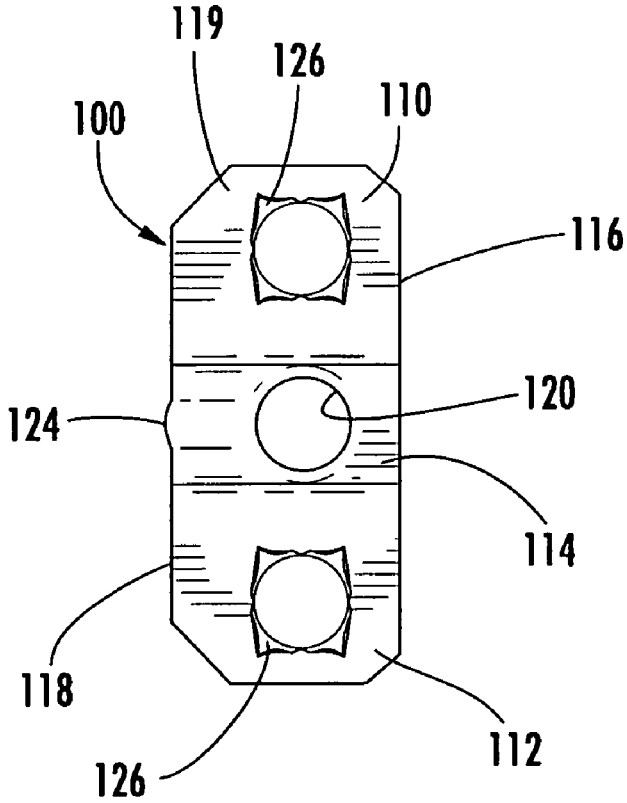
FIG. 10 is a bottom plan view an embodiment of the base plate of the present invention.
Figure 11:
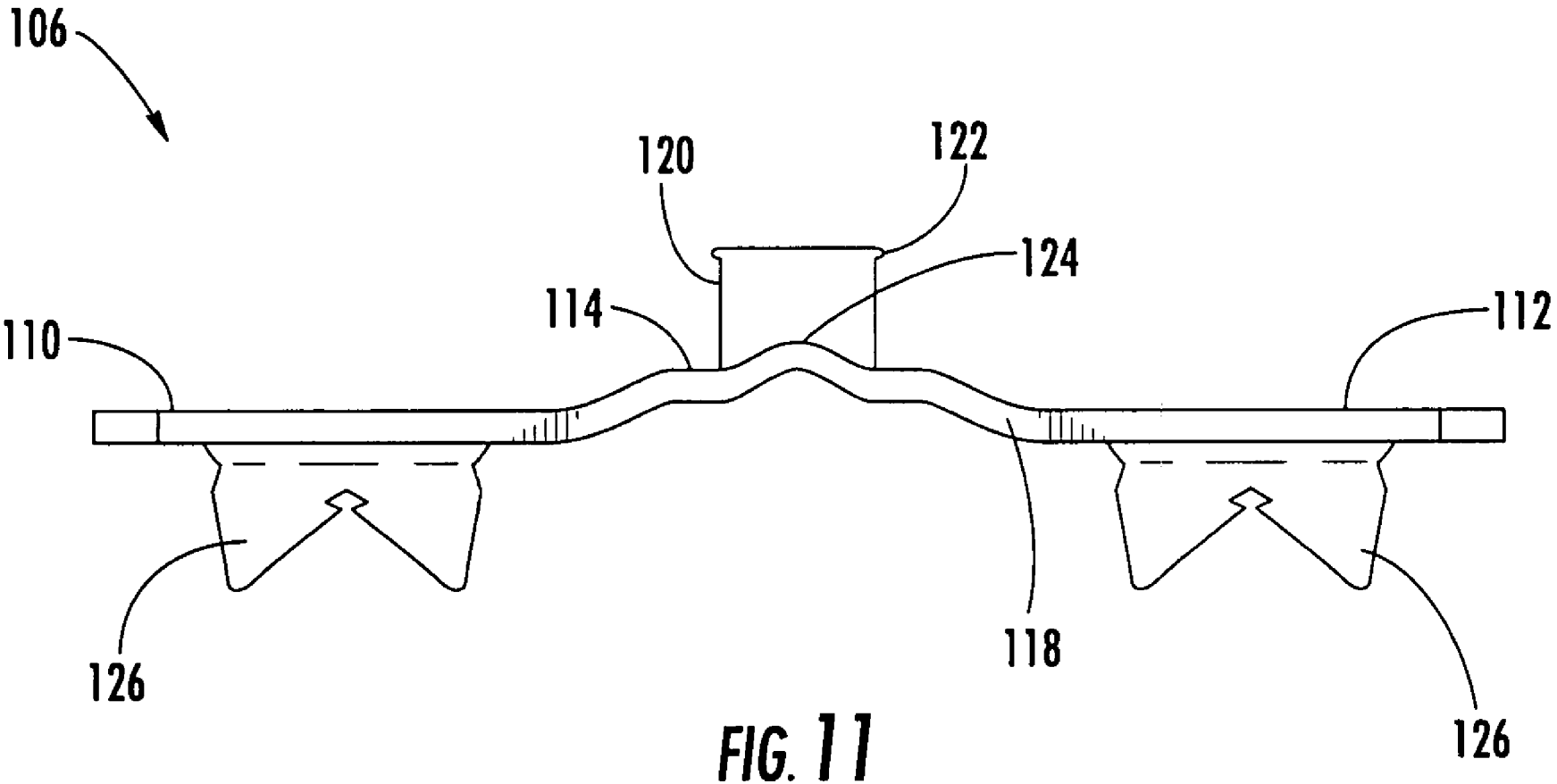
FIG. 11 is a rear elevational view an embodiment of the base plate of the present invention.

Referring now to FIGS. 9 through 11, an embodiment the base plate 106 of the turn button 100 of the present invention is shown without the latch plate 108 illustrated for ease of discussion. The base plate 106 is generally shaped as an elongated piece of metal, although other materials could be used, having a first end 110, a second end 112, and a centrally raised platform 114. The base plate 106 also has a leading and trailing edges 116, 118 and top and bottom surfaces 117, 119. Extending from the platform 114 is an annular pivot wall 120 having an upper lip 122. The upper lip 122 of the pivot wall 120 is turned or flared slightly outwardly during manufacturing to permanently attach the latch plate 108 to the base plate 106. Also extending from the platform 114 and near the trailing edge 118 of the base plate 106 is a detent stop 124. Depending from the first and second ends 110, 112 of the base plate 108 are fastening structures 126. The fastening structures 126 shown are rosettes formed through punching a metal punch through the base plate 106 material, but could be other structures such as rivets, staples, downwardly turned claw feet, or a flared cylinder. The fastening structures 126 driven into the picture frame back 104 (or picture frame 102 as the case may be) to permanently attach the turn button 100. Securing rosettes to cardboard an other fasteners to other materials need not be discussed herein as they are well known in the art.

Figure 12:
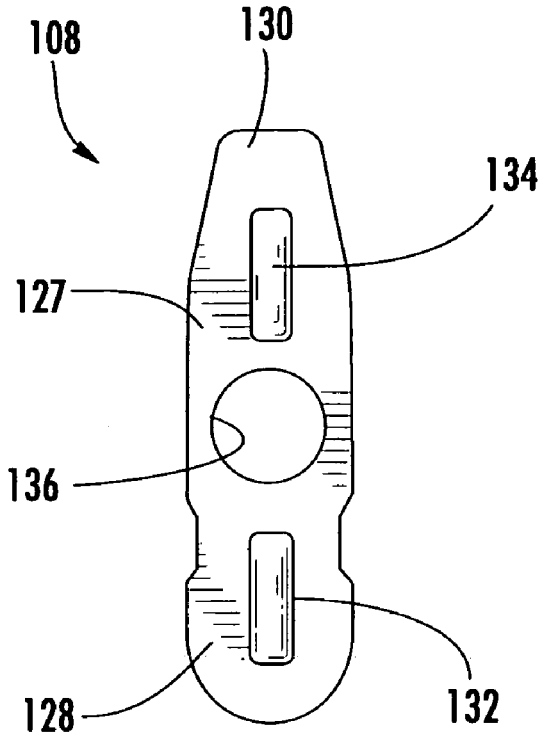
FIG. 12 is a top plan view an embodiment of the latch plate of the present invention.
Figure 13:
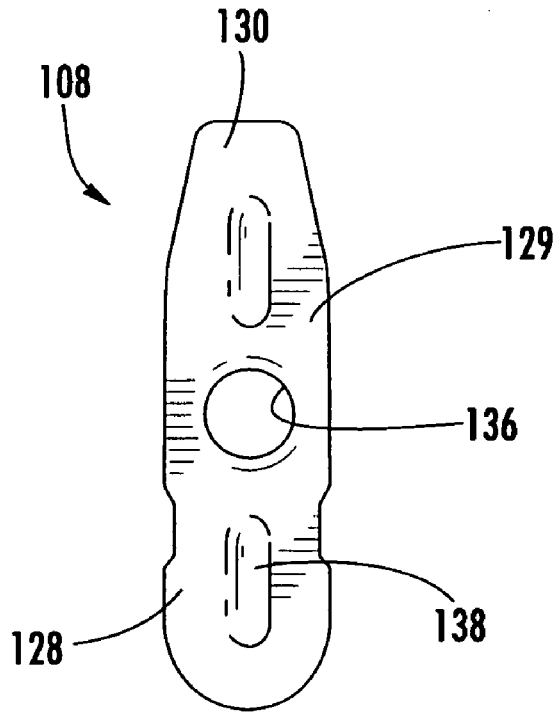
FIG. 13 is a bottom plan view an embodiment of the latch plate of the present invention.

Referring now to FIGS. 12 and 13, an embodiment of the latch plate 108 of the turn button 100 of the present invention is shown without the base plate 104 illustrated for ease of discussion. The latch plate 108 has a top and bottom surface 127, 129, an arm portion 128 and a tongue portion 130 extending therefrom 128. There are two raised shoulders 132, 134, one extending from the arm portion 128 and the other from the tongue portion 130 of the top surface 127 of the latch plate 108. The raised shoulders 132, 134 provide a gripping surface to ease operation, namely rotation, of the turn button 100 between the engaged and disengaged states. Between the two raised shoulders 132, 134 is an annular pivot edge 136 forming a hole wherein the pivot wall 120 of the base plate 106 is pivotably received. Once the latch plate 108 is mounted to the base plate 106, the upper lip 122 of the pivot wall 120 is flared outwardly to permanently attach the latch plate 108 to the base plate 106.

On the bottom surface 127 of the latch plate 108 is a detent seat 138. The detent seat 138 is designed to be a generally complimentary fit to the detent stop 124 on the base plate 106. When the latch plate 108 is manipulated to the engaged state the bottom surface 127 of the latch plate 108 rides up and over the detent stop 124. The detent stop 124 snaps into the detent seat 127 and prevents the latch plate 108 from pivoting out of the engaged state without some external lateral force being applied to the latch plate 108.

Referring back to FIGS. 6A and 6B, the turn button 100 is positioned on a picture frame back 104 and oriented so that the leading edge 116 of the base plate 106 is closest to an edge of the picture frame back 104 such that when the latch plate 108 is manipulated to the engaged state the tongue portion 130 of the latch plate 108 extends over the edge of the picture frame back 104 to lock the picture frame back 104 in place. Alternatively, the turn button 100 could be mounted directly to the picture frame back 104 with the tongue portion 130 of the latch plate 108 extending into a slot (not shown) in the frame 102.

Figure 14:
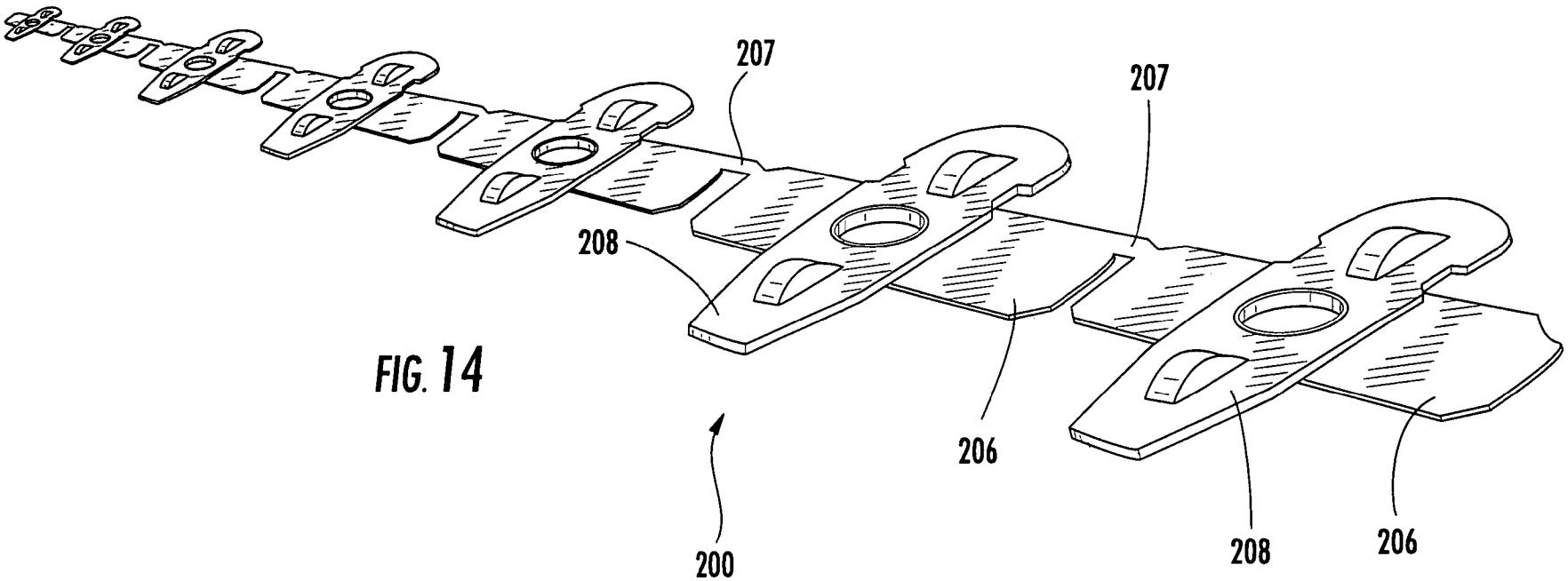
FIG. 14 is a perspective view of the present invention in strip-form in the process of being formed.

Referring now to FIG. 14, a process of installing of the turn button of the present invention is shown where a coil array of turn buttons are fed through an automated mounting machine (not shown) such as the COBRA manufactured by Craft, Inc., is shown generally at 200. The coil-fed turn button 200 consists of a plurality base plates 206 with a plurality of complimentary latch plates 208 pivotably mounted thereon and operable between an engaged state and a disengaged state. The base plates 206 are held together in strip-form by cut-away tabs 207. This configuration enables the coil-fed turn button 200 of the present invention to be coiled on a spool and fed through a mounting machine, which cuts away the tab 207 and mounts the turn button 200 to a picture frame back (not shown) or a picture frame (not shown) as described above previously using the appropriate anvils and other installation equipment.

Figure 15A:
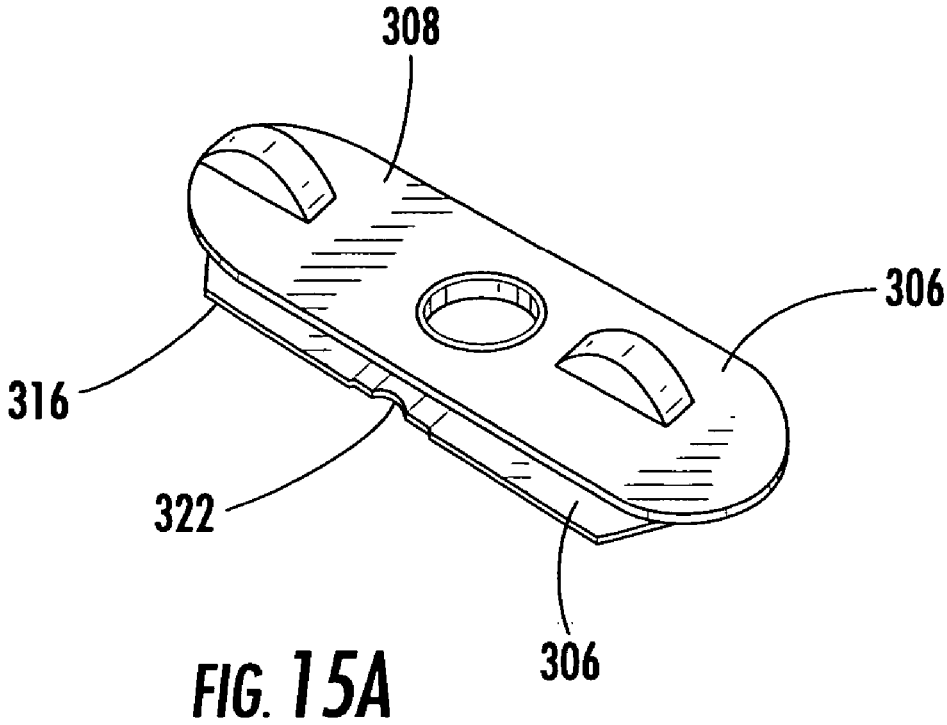
FIG. 15A is a perspective view of another embodiment of the present invention in the disengaged state.
Figure 15B:
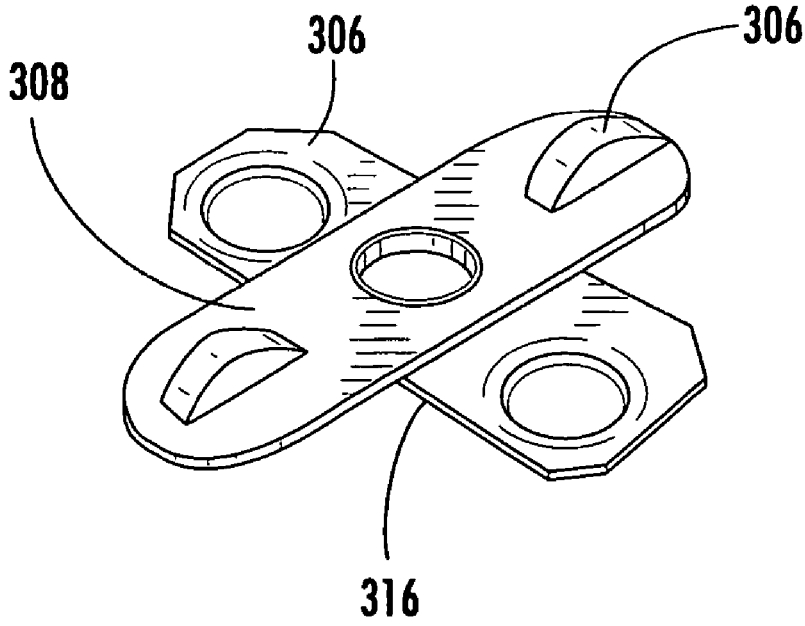
FIG. 15B is a perspective view of another embodiment of the present invention in the engaged state.

Although the present invention has been described in considerable detail with reference to a certain preferred versions thereof, other versions are possible. For example, FIGS. 15A and 15B depict an alternative embodiment in which the detent stop 322 is located near the leading edge 316 of the base plate 306 and the complimentary detent seat (not shown) is on the tongue portion 330 of the bottom surface (not shown) of the latch plate 308.

Therefore, the present invention provides a new and improved turn button assembly that can be installed on a picture frame back or picture frame itself to prevent the picture frame back from hingedly opening. The turn button has a smooth operation while being maintainable in a locked condition. As a result, the turn button of the present invention is a significant improvement over prior art turn buttons.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A turn button comprising:

a base plate having a top and bottom surface, the base plate having at least one fastener depending from the bottom surface, and a raised detent stop extending from the top surface of the base plate;

a latch plate pivotably mounted to the base plate such that it may be operated between an engaged state and a disengaged state; the latch plate having a tongue portion, an arm portion, and a complementary detent seat matable with the raised detent on the base plate when in the engaged state; and a first raised shoulder extending from the arm portion of the latch plate and defining a recess on the opposing side of the arm portion; the first raised shoulder facilitating the pivoting of the latch plate between the engaged and disengaged states with the recess being the detent seat.

2. The turn button of claim 1, wherein the latch plate further comprises a second raised shoulder extending from the tongue portion of the latch plate to facilitate pivoting the latch plate between the engaged and disengaged states.

3. A turn button comprising:

a base plate having a top and bottom surface, a leading and a trailing edge, the leading edge opposite of the trailing edge, a centrally located raised platform;

an annular pivot wall extending from the raised platform of the base plate;

a raised detent on the raised platform and near the trailing edge of the base plate;

a latch plate having an arm portion, a tongue portion extending from the arm portion, a top and a bottom surface, an annular pivot edge defining a hole located between the tongue portion and the arm portion and sized to fit around the pivot wall, two raised shoulders extending from the top surface of the latch plate, the first raised shoulder on the arm portion and the second raised shoulder on the tongue portion of the latch plate; and the latch plate pivotably mounted to the base plate such that the annular pivot wall of the base plate is received within the hole of the latch plate, the bottom surface of the latch plate contacting the top surface of the base plate on the raised platform, the annular pivot edge and annular pivot wall forming a pivot joint such that the latch plate may be rotated between an engaged state and a disengaged state, the bottom surface of the latch plate having a detent seat which engages the detent stop on the base plate when the latch plate is pivoted to the engaged state.

* * * * *